United States Patent [19]

Chang

[11] Patent Number: 4,700,112

[45] Date of Patent: Oct. 13, 1987

[54] FLUORESCENT LAMP LIGHTING CIRCUIT

[76] Inventor: Ming J. Chang, No. 23, Lane 7,Chung-Te-Four Street, Chung-Shiel Li, Tainan, Taiwan

[21] Appl. No.: 883,494

[22] Filed: Jul. 8, 1986

[51] Int. Cl.[4] ..... H05B 37/00

[52] U.S. Cl. ..... 315/205; 315/206; 315/208; 315/223; 315/244; 331/113 A

[58] Field of Search ..... 315/205, 206, 208, 223, 315/244; 331/113 A

[56] References Cited

U.S. PATENT DOCUMENTS

| | | | |
|---|---|---|---|
| 3,008,068 | 11/1961 | Wilting et al. | 315/206 |
| 3,247,422 | 4/1966 | Schultz | 315/206 |
| 3,395,315 | 7/1968 | Fontaine | 315/205 |
| 3,973,165 | 8/1976 | Hester | 331/113 A |
| 4,109,307 | 8/1978 | Knoll | 315/205 |
| 4,544,862 | 10/1985 | Yamazaki et al. | 315/226 |
| 4,562,382 | 12/1985 | Elliott | 315/205 |

*Primary Examiner*—Harold Dixon
*Attorney, Agent, or Firm*—Morton J. Rosenberg

[57] ABSTRACT

A flourescent lamp lighting circuit comprising a rectifying circuit and an oscillatory circuit. The rectifying circuit comprises a rectifier bridge, capacitors and coils to rectify the local alternating power supply to direct power supply and provide rectified electrical power to the oscillatory circuit. The oscillatory circuit comprises two transistors and an L-C circuit which, taken together, form an astable circuit which generates and maintains oscillations. The frequency of the oscillations is determined by the nature of L-C circuits. The ON's and OFF's of the transistors are controlled by induction coils within which currents are induced by the variation of magnetic flux in the inductor coil of the L-C circuit. The high frequency oscillations in the oscillatory circuit induce high frequency electrical signals on a secondary coil which then lights the fluorescent lamp.

1 Claim, 3 Drawing Figures

FLUORESCENT LAMP LIGHTING CIRCUIT

BACKGROUND OF THE INVENTION

The main advantages of fluorescent lamps are that they emit highly intense light and save electrical power, in comparison with incandescent bulbs.

However, conventionally, in order to activate a fluorescent lamp, a starter has been needed. And when the starter is out of order, one can never light the fluorescent lamp without first changing the out-of-order starter.

In conventional fluorescent lamp lighting circuits, since the frequency of the alternating current is quite low, noticeable flickers exist when the lamp fluoresces periodically in response to the frequency of alternating current. This causes a stroboscopic effect which could be harmful to the user's eyesight.

In addition, due to the necessity and use of the starter in conventional flourescent lamps, when switched on, the lamp does not fluoresce immediately until a lamp current is built up in the fluorescent lamp.

SUMMARY

Therefore, the primary object of the present invention is to provide a fluorescent lamp lighting circuit which can apply a high frequency, high voltage electrical current to the fluorescent lamp and have the lamp fluoresce immediately after being switched on.

It is another object of the present invention to provide a fluorescent lamp lighting circuit which can light the fluorescent lamp with much less noticeable flickers, thus, elminating or reducing the stroboscopic effect.

It is a further object of the present invention to provide a fluorescent lamp lighting circuit, wherein a plurality of fluorescent lamps can be connected in serial, provided that the total power consumption is within the rated power of the circuit itself.

It is a further object of the present invention to provide a fluorescent lamp lighting circuit which comprises an A.C. filter to reduce the influences of noise and improve the lighting effectiveness of the fluorescent lamp.

It is a further object of the present invention to provide a fluorescent lamp lighting circuit which consumes less power than the prior art.

DETAILED DESCRIPTION OF THE PREFERRED EMBODIMENTS

Figure 1:
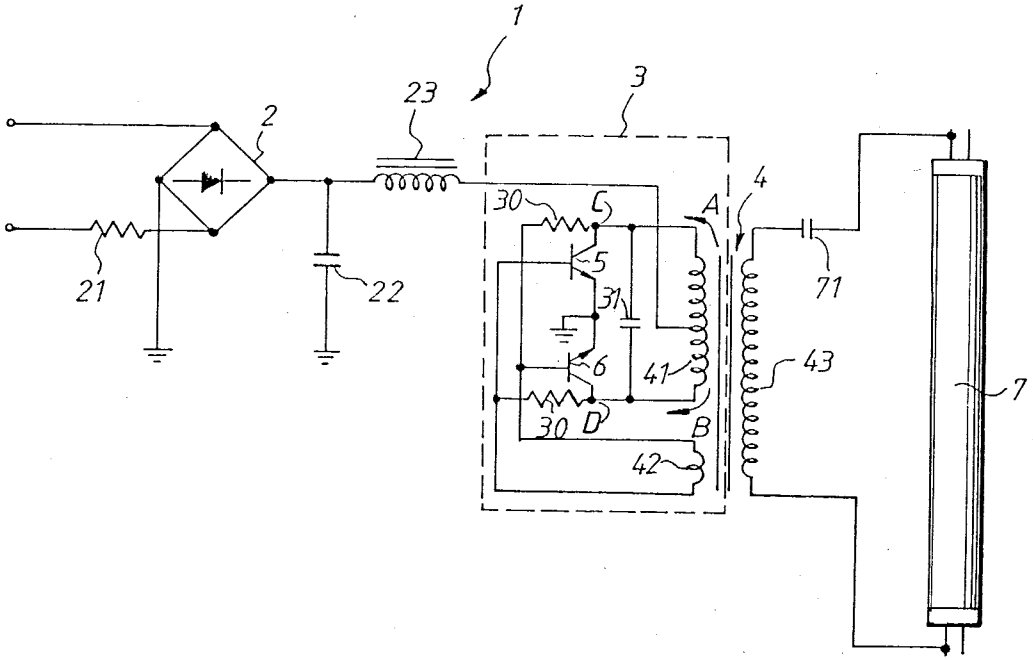
FIG. 1 shows a lighting circuit for the fluorescent lamps in accordance with the present invention.

Referring to FIG. 1, which shows the first embodiment of circuit system 1 of the present invention, it can be seen that a rectifier bridge 2, which is constituted by four diodes, connects to the local power supply, usually having a voltage of 110 V or 220 V, via a resistor 21. The resistor 21 is used to restrict the current flowing into the rectifier bridge 2. The output terminal of the rectifier bridge 2 connects to a capacitor 22 acting as high frequency filter. The output of the rectifier bridge 2 is then sent to an oscillatory circuit 3 via a choke 23 after filtered by the filter 22. When a high frequency oscillation is built up in the oscillatory circuit 3, the choke 23 interrupts the electrical connection between the rectifier bridge 2 and the oscillatory circuit 3, so as to prevent interference with the oscillatory circuit 3.

Basically, the oscillatory circuit 3 is constituted by a transformer 4 and an astable circuit including two transistors 5 and 6. The transformer 4 comprises a primary winding 41, an induction winding 42 and a secondary winding 43. The secondary winding 43 connects the fluorescent lamp 7 via a capacitor 71, thus constituting an L-C oscillatory circuit.

The two ends of the induction winding 42 are connected to the bases of transistors 5 and 6 respectively as triggering means for transistors 5 and 6. The emitters of transistors 5 and 6 are both grounded. The collector of each transistor is connected to one end of the primary winding 41 and a capacitor 31 is disposed between the collectors of the transistors in parallel with the primary winding 41. The system is further provided with a biasing means which is a resistor 30 connected between the collector of each transistor and the connection of the base of the other transistor with the induction winding 42.

The output terminal of the choke 23 is connected to the middle of the primary winding 41 to supply rectified and filtered current to the oscillatory circuit 3. When electricity flows through the lighting circuit of the present invention, a direct current output from the rectifier bridge 2 is filtered by the capacitor 22 and then sent to the primary winding 41 through the choke 23.

When the oscillatory circuit 3 receives a direct current signal, one of transistors 5 or 6 will be triggered and turned on due to the inherent differences between transistors 5 and 6. Suppose that transistor 5 is turned on first, then the direct current sent into the primary winding 41 will flow along the arrow A to the connection point C and then through the transistor 5 to the ground. When the current flows in such a way, a current is induced within the induction winding 42 so that an electrical potential is established therein. The induction winding 42 is so wound on the magnetic core that when a transistor, (in this example transistor 5), is turned on, the electrical potential built up therein will have a negative polarity at the base of the ON-state transistor 5 and a positive polarity at the base of the other transistor 6, which is off. With a negative polarity being applied to the ON-state transistor 5 and a positive polarity being applied to the OFF-state transistor 6, the transistor 5 will be switched off and the transistor 6 switched on. When transistor 6 is turned on, the current within the primary winding 41 will flow in the direction of arrow B and pass connection point D and transistor 6 to the ground. This will induce a potential with inverted phase in winding 42, thus switching transistor 6 off and transistor 5 on again. With transistors 5 and 6 alternating ON and OFF, an electrical oscillation builds up in the oscillatory circuit 3, thus inducing a high frequency and high voltage current within the secondary winding 43 of the transformer 4. The frequency of the current signal induced in secondary winding 43 is determined by the nature of the capacitor 71 and secondary winding 43 itself.

The capacitor 31, together with the primary winding 41, establishes an L-C oscillation therewithin with a frequency which is approximately the natural frequency thereof. Whenever an electrical oscillation is established within the oscillatory circuit 3, a resonance will form in the secondary winding 43 with the frequency thereof determined by the secondary winding 43 and the capacitor 71. In practice, it is possible to have an oscillation frequency of 30 kHz and a transient starting voltage as high as 1,000 volts on the L-C circuit constituted by the secondary winding 43, the capacitor 71 and the fluorescent lamp 7. The electrical potential across the lamp 7 will drop from the 1,000 volts starting voltage to the low lamp voltage within a very short period after the lamp 7 is turned on.

Usually, the frequency of alternating local power supply is 60 Hz which is much lower than the frequency of the present circuit, 30 kHz. Therefore the fluorescent material coated on inside surface of the fluorescent lamp 7 will be struck by ionized molecules many more times than conventional fluorescent lamps. This increases the density of the light spots on the fluorescent tube, thus making the flickers much less noticeable and eliminating or reducing the stroboscopic effect.

Figure 2:
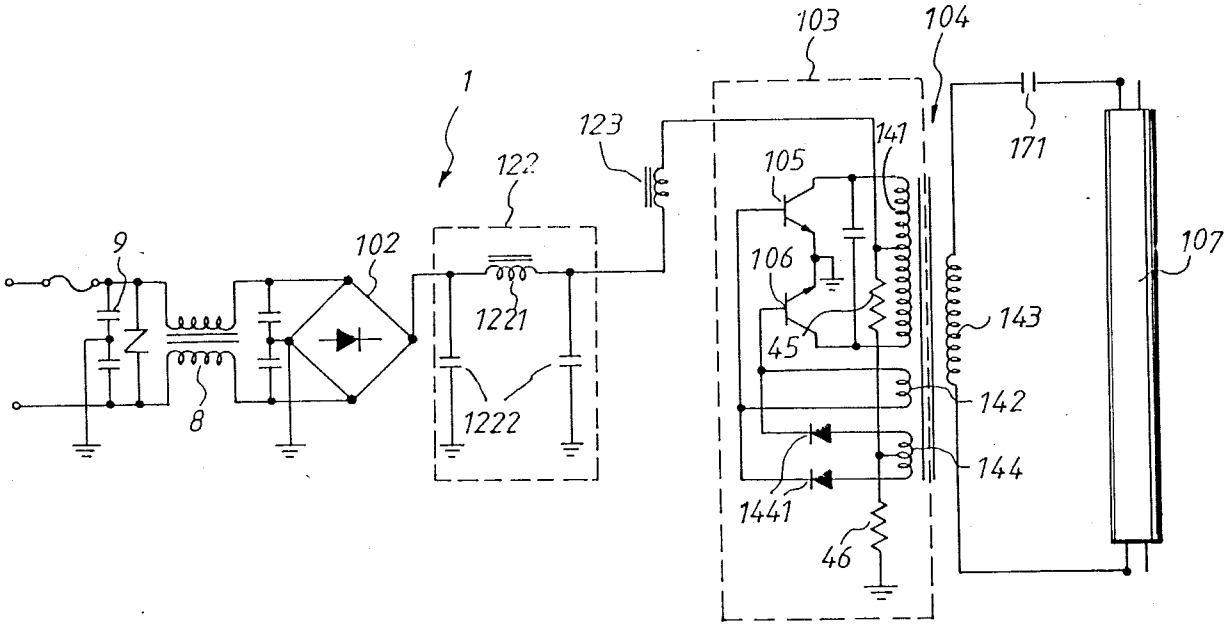
FIG. 2 shows another embodiment of the present invention.

Referring to FIG. 2, a second embodiment of the present invention can be seen and wherein (elements in FIG. 2)=(elements in FIG. 1+100). For example, reference number 23 in FIG. 1 is the same element as 123 in FIG. 2. Also, oscillatory circuit 103 is encircled by dashed lines. An AC filter constituted by a filter 8 and four capacitors 9 is connected between a rectifier bridge 102 and a local AC power supply. The above-mentioned AC filter is familiar to those skilled in this art and as such will not be described in detail herein. The output of the rectifier bridge 102 is connected to a TT filter 122 constituted by a choke 1221 and two parallel capacitors 1222. The TT filter 122 is meant to filter the ripple of current signal. Disposed between the TT filter 122 and the oscillatory circuit 103 is another choke 123 which is meant to interrupt the electrical connection between the oscillatory circuit 103 and the power source under high frequency condition to prevent any interference therebetween. The current signal out of the choke 123 flows into the oscillatory circuit 103 and builds up oscillations therewithin.

The oscillatory circuit 103 has the same basic form shown on FIG. 1, however, a second induction winding 144 is added thereto. The middle position of the second induction winding 144 is connected to the middle position of the primary winding 141 via resistor 45 and also grounded via resistor 46. This is to bias the second induction winding 144. Therefore, a non-zero potential level exists in the second induction winding 144 and when a current is induced in the second induction winding 144, as the case in the first induction winding 142, the voltage thereof will be higher. The two terminals of the second induction winding 144 are connected, respectively, to the bases of transistors 105 and 106 via diodes 1441. This higher voltage, when applied to the base of transistors 105 or 106, will facilitate the speed of switching the transistors on, thus improving the oscillation established within the oscillatory circuit.

Figure 3:
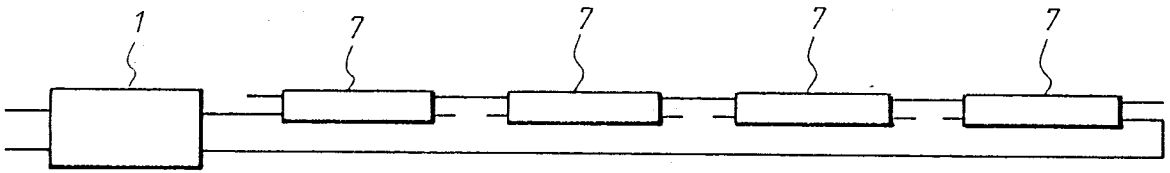
FIG. 3 illustrates the application of the present invention.

In addition, within the range of rated power, the present invention is able to light a plurality of fluorescent lamps 7 in serial, as shown on FIG. 3. This is because in the present invention, only a base pin in each base of the fluorescent lamp is used to construct the whole circuit, rather than two base pins of each base are both used in the prior art.

I claim:

1. A fluorescent lamp lighting circuit having a rectifying circuit and an oscillator circuit, said oscillator circuit comprising:

(a) a coil receiving rectified current from said rectifying circuit at a middle portion thereof;

(b) a first induction winding inducing a circuit therewithin in response to variations of magnetic flux within said coil;

(c) a second induction winding having an electrical signal of the same phase therewithin whenever an electrical signal is induced within said first induction winding, and an active bias means formed by two resistors connected in serial between the middle of said coil and ground, said two resistors being connected to the middle of said second induction winding;

(d) a pair of transistors including respective grounded emitters, said transistors having collectors connected to the terminals of said coil respectively and bases connected to either of two terminals of said first induction winding; and, (e) a capacitor with either end thereof connected to said collector of one of the transistors and either end of said capacitor being in parallel with said coil, said coil having a current passing therethrough producing a variation of magnetic flux within said coil and inducing an electrical potential within said first induction winding when one of said transistors is switch ON; said first induction winding and said bases of said transistors being so connected that negative polarity of the potential induced in said first induction winding is applied to an ON-state transistor and OFF positive polarity is applied to an OFF-state transistor, thus turning OFF the originally ON transistor and turning ON the originally OFF transistor; a current of inverted phase being built up within said coil when the original states of said transistors are interchanged, thus inducing an inverted phase signal within said first induction coil which interchanges the states of said transistors again; and such that periodical interchange of the states of said transistors makes an electrical oscillation within said circuit whose frequency is determined by the natural frequency of said coil and said capacitor.

* * * * *